United States Patent [19]

Olsen

[11] Patent Number: 4,724,037

[45] Date of Patent: Feb. 9, 1988

[54] MICRO-ADJUSTABLE GRAVURE ROLL

[75] Inventor: Robert F. Olsen, Toledo, Ohio

[73] Assignee: Owens-Illinois Glass Container Inc., Toledo, Ohio

[21] Appl. No.: 856,241

[22] Filed: Apr. 28, 1986

[51] Int. Cl.[4] ..... B65C 11/04

[52] U.S. Cl. ..... 156/578; 118/256; 118/258; 118/259; 118/261; 118/262

[58] Field of Search ..... 118/256, 258, 259, 261, 118/262; 156/578; 403/43–48

[56] References Cited

U.S. PATENT DOCUMENTS

| | | | |
|---|---|---|---|
| 2,581,180 | 1/1952 | Entwistle et al. | 118/259 |
| 3,028,645 | 4/1962 | Stearman et al. | 403/47 X |
| 3,397,675 | 8/1968 | De Ligt | 118/258 |
| 3,605,687 | 9/1971 | Russell | 118/262 |
| 4,574,020 | 3/1986 | Fosnaught | 156/80 |

FOREIGN PATENT DOCUMENTS

| | | | |
|---|---|---|---|
| 0684203 | 11/1939 | Fed. Rep. of Germany | 118/261 |
| 0712139 | 1/1980 | U.S.S.R. | 118/258 |

*Primary Examiner*—Donald E. Czaja

*Assistant Examiner*—Jeff H. Aftergut

*Attorney, Agent, or Firm*—H. G. Bruss

[57] ABSTRACT

A labeling system where a cylindrical vacuum drum carries plastic labels at spaced intervals on its surface and a solvent applying gravure roll is held at a specific spacing from the drum and labels so that the labels will receive the solvent when they pass the rotating roll. The gap between the drum and the roll must be carefully controlled in order to be assured that the solvent is properly transferred. The gap is controlled by a fine adjustment of the platform on which the roll is mounted relative to the drum by a threaded rod moving a tapered surface of a reciprocable member in contact with a stop block mounted on the platform. The threaded rod threads through a stationary bracket and turns a shaft that threads into the member. The member is prevented from rotation so that rotation of the rod moves the member in one direction while rotation of the shaft moves the member in the opposite direction. This differential movement gives a micro-adjustment to the platform and the roll relative to the surface of the vacuum drum.

3 Claims, 4 Drawing Figures

MICRO-ADJUSTABLE GRAVURE ROLL

BACKGROUND OF THE INVENTION

In the production of bottles with thermoplastic sleeve labels that are heat shrunk about the bottle sidewall, shoulder and heel areas, it has been the practice to form the sleeves from label blanks that are wound on a cylindrical mandrel with the trailing edge overlapping the leading edge. The overlap is engaged by a heated sealing bar and forms a heat sealed seam extending the height of the sleeve. The sleeve is then telescoped over the bottle and the assembled sleeve and bottle are passed through a heat tunnel with bottle and sleeve being rotated to expose the full circumference of the sleeve to the heat to evenly shrink the label and cause it to conform to the exterior configuration of the bottle. The sleeves may be positioned with their lower margins below the bottom of the bottles, in which case the sleeve will be shrunk over the heel and the bearing surface as well. Such a process and apparatus is disclosed in U.S. Pat. No. 3,802,942 issued Apr. 9, 1974.

A more recent U.S. Pat. No. 4,574,020, issued Mar. 4, 1986, discloses a method and apparatus for applying heat shrinkable, thermoplastic wrap-around labels to containers by providing a web of foamed polystyrene sheet material which is subsequently cut into label lengths equal to the circumference of the containers plus an overlap seam area. The web of material is held to the surface of a rotating vacuum drum and, as the drum rotates about its vertical axis, the web is cut into label length. With the label adhering to the vacuum drum surface, the outer surface of the web is brought into contact with a rotating gravure roll which has a gravure pattern that contains a solvent for the material and will apply the solvent to finite areas of the leading and trailing edge of the label. With the solvent applied to the label, the label is brought into rolling contact with a container where the leading edge of the label adheres to the container and with the container rolled along the label surface, the trailing edge will overlap and become sealed to the leading edge by the solvent action.

In the operation of the above system, one of the most critical aspects is the precise transfer of the solvent from the gravure roll to the surface of the label. If the gravure roll surface and the label surface do not make proper contact, there will not be sufficient solvent applied to the label in order to dissolve the label so as to make it adhere to the bottle or container as it comes into contact therewith and transfers thereto. Likewise, as the label trailing edge overlaps the leading edge, it is absolutely necessary that the trailing edge will have received a full height strip of solvent applied thereto so that a complete overlap seam will be formed. This seam has to be complete since subsequent heat shrinkage of the label about the bottle will open the seam up and produce a defective label if the seam is not sealed throughout its full height.

The label carrying vacuum drum has sets of raised areas or pads on its periphery which will underlie the leading and trailing edges of the label and the rotating gravure roll will be set to engage the label at these critical points in the relative rotation of the drum and roll. The gravure roll is normally mounted on a platform which is shiftable about a vertical axis which is parallel to the axis of the roll. The platform is biased in one direction and carries an abutment which is intended to engage the end of a threaded bolt which can be turned to provide an adjusted stop. The abutment and bolt are fairly close to the axis about which the platform is shiftable.

Slight adjustment of the bolt will result in a fairly large relative movement of the roll relative to the drum.

With the foregoing in view, it is an object of the present invention to provide a system for mounting the gravure roll on its platform and for moving the platform, to adjust the roll position relative to the drum, which will provide a micro-adjustment of the axis of the gravure roll relative to the drum so that a better system for setting the caliper may be accomplished than in the past.

It is a further object of the present invention to provide an adjusting means for the spacing between the gravure roll and the vacuum drum which can be carried out more easily and conveniently than in the past.

Other and further objects will be apparent from the following description taken in conjunction with the attached drawings.

DETAILED DESCRIPTION OF THE DRAWINGS

Figure 1:
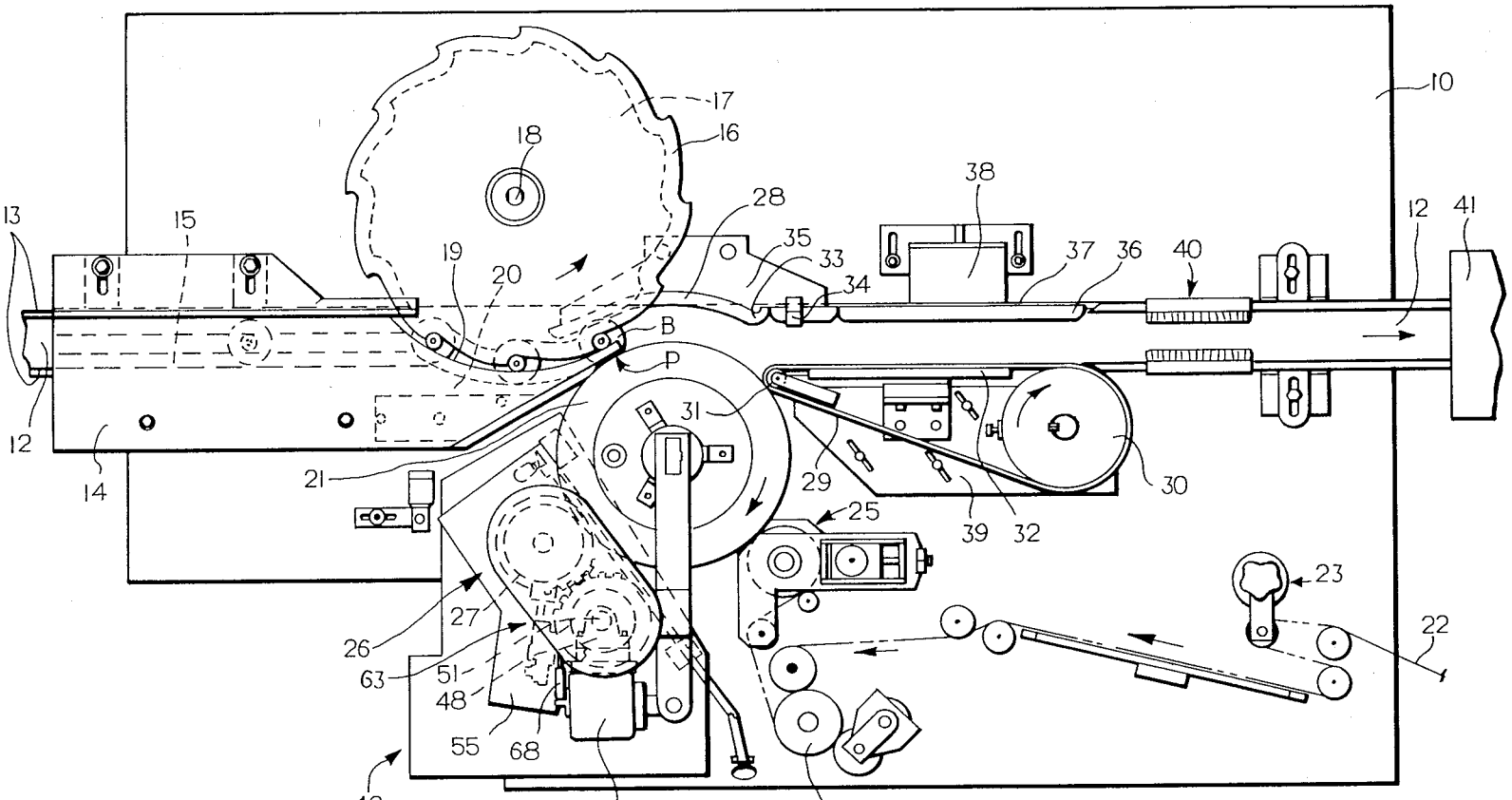
FIG. 1 is a schematic plan view system for wrapping labels about bottles incorporating the gravure roll adjustment of the invention.

With particular reference to FIG. 1, the following is a general description of the operation of the overall labeling system. A horizontal supporting table 10 of generally rectangular configuration serves to support the mechanisms and is itself supported above the floor by a plurality of vertical legs (not shown). Mounted above the table and extending generally across the length of the table is a conveyor generally designated 11. The conveyor 11 has a horizontally moving upper surface 12 which is driven in the direction of the arrow shown thereon. Containers or bottles B to be labeled are supplied at the left hand end of the conveyor 11 in an upright attitude on the surface 12 of the conveyor. With the conveyor surface 12 moving in the direction of the arrow thereon, the bottles will be carried from the left to the right as viewed in FIG. 1. The bottles are guided by rails 13 which extend along either side of the conveyor 12. An overhead member 14 is shown which is provided in its under surface with a guiding slot 15 within which the finish or neck of the bottles will be guided. As can be seen when viewing FIG. 1, the bottles moving from the left approach a pair of vertically spaced, pocketed starwheels 16 and 17 which are both mounted to a vertical axle 18 which is rotated in a counterclockwise direction as viewed in FIG. 1. The starwheel 16 has 12 pockets circumferentially spaced about the circumference thereof which pockets are adapted to engage the neck of the bottles being handled and the starwheel 17 is provided with a like number of pockets that are of somewhat larger dimension and are adapted to engage the sidewall of the bottles being handled.

An arcuate guide 19 has a contour which is coaxial with respect to the axle 18 and serves to hold the necks of the bottles at a precise distance from the axle 18 of the starwheel 16. In addition, there is a lower arcuate guide 20 which is mounted at a height generally the same as the height of the sidewall or body engaging starwheel 17 to maintain the bottles B with their axes vertical during the movement of the bottles by the starwheels 16 and 17. When a bottle reaches the position generally designated P, the side of the bottle B will approach, generally tangentially, the circumferential periphery of a vacuum drum 21. The vacuum drum 21 is a generally cylindrical member having a height somewhat greater than the height of a label which is to be applied to the bottles B. The drum 21 will have a plurality of vacuum passages opening through the surface thereof to, in effect, grip the individual labels supplied thereto and to convey the labels to the position P. The labels may be formed from a web 22 of foam-film polystyrene which may be pre-printed and which will be coming from a supply (not shown) at the right through a tension takeup device 23. After passing the tension compensating device 23 the web 22 will pass around a driven feed roller 24 and then to a label cutting and handling system generally designated 25. The label cutting device 25 cuts the label at a predetermined point in its length with the leading edge of the label being brought into peripheral engagement with the drum 21. The label will adhere to the outer surface of the drum 21 and move in the direction of the arrow on the drum 21 to carry the label past a glue or solvent applying station 26 where a glue roll or solvent transfer gravure roll 27 will apply the glue or solvent to selected, defined areas of the label. The gravure roll 27 is driven by a mechanism (not shown) generally in a counterclockwise direction, as viewed in FIG. 1, and timed to present the solvent to the leading and trailing edges of the label which is transported by the vacuum drum 21.

At the point P the leading edge of the label will engage the sidewall of the bottle B and the leading edge of the label will become adhered to the bottle. From this point on, the bottle will be held against the surface of the drum by a primary backup pad 28 which is mounted to the surface of the table 10 by a bracket 35. The backup pad 28 may be formed of a resilient foam material such as foam rubber so that it will effectively hold the bottle B against the surface of the drum and as the drum continues to rotate the bottle will be effectively rolled along the surface of the label carried on the surface of the vacuum drum 21.

As previously described, the label carried by the drum 21 will have a vertical, full height, line of solvent applied to the trailing edge thereof and the trailing edge of the label will overlap the leading edge and adhere thereto to form an overlap seam. The container with the label applied continues to be guided by the primary backup pad 28 until it reaches a secondary roll-on belt 29. The secondary roll-on belt 29 passes about a drive roll 30 which is driven in the direction of the arrow shown thereon. The belt 29 also passes about a relatively small diameter inlet roll 31. A stationary, vertical backup surface 32 maintains the belt 29 in a fairly straight path between the drive roll 30 and the inlet roll 31. The bottle B will have the label completely wrapped thereabout prior to the movement of the bottle into engagement with the secondary roll-on belt 29. The primary backup pad 28 has an area 33 which tends to maintain the bottle in contact with the vacuum drum 21 until such time as the bottle engages the secondary roll-on belt 29. This provides a positive drive for the bottle so that when the bottle passes to the secondary roll-on belt, it will be rotated while moved along by the moving surface of the belt 29. The moving belt drives the rolling bottle so that the overlap seam of the label will contact a resilient pressing pad 34 which is mounted beyond the primary pad 28 on a bracket 35 which in turn is mounted to the table 10 as previously described.

A secondary backup pad is positioned in bottle engaging, diametrically opposed, position relative to the secondary roll-on belt 29. The pad 36 is also formed with a foam rubber or like resilient member mounted to a plate 37 which in turn is mounted by bracket 38 to the top of the table 10.

It perhaps should be pointed out also that the secondary roll-on belt 29 and its drive roll 30 and inlet roll 31 are both mounted on a mounting plate 39 which may be moved relative to the upper surface of the table 10, and thus be adjusted toward or away from the center line of the conveyor 12 to accommodate the mechanism for different size bottles. Likewise, the secondary backup pad 36 and the bracket 38 which supports it may be moved toward or away from the center line of the conveyor 12.

As can be seen when viewing FIG. 1, the bottles B, after passing between the secondary backup pad and the secondary roll-on belt, will be held back by the brush spacer, generally designated 40, and that the bottles are moved through the brush spacer 40 in surface-to-surface contact under the force created by the moving belt 29, until such time as the leading bottle clears the spacer 40, at which time the bottle is free to move at the speed of the conveyor 12 into a heat shrink oven 41. The bottles will leave the brush spacer at regular intervals depending upon the speed with which the label wrap machine is operating. It should be understood that the drum 21 and drive roll 30 are commonly driven.

Figure 2:
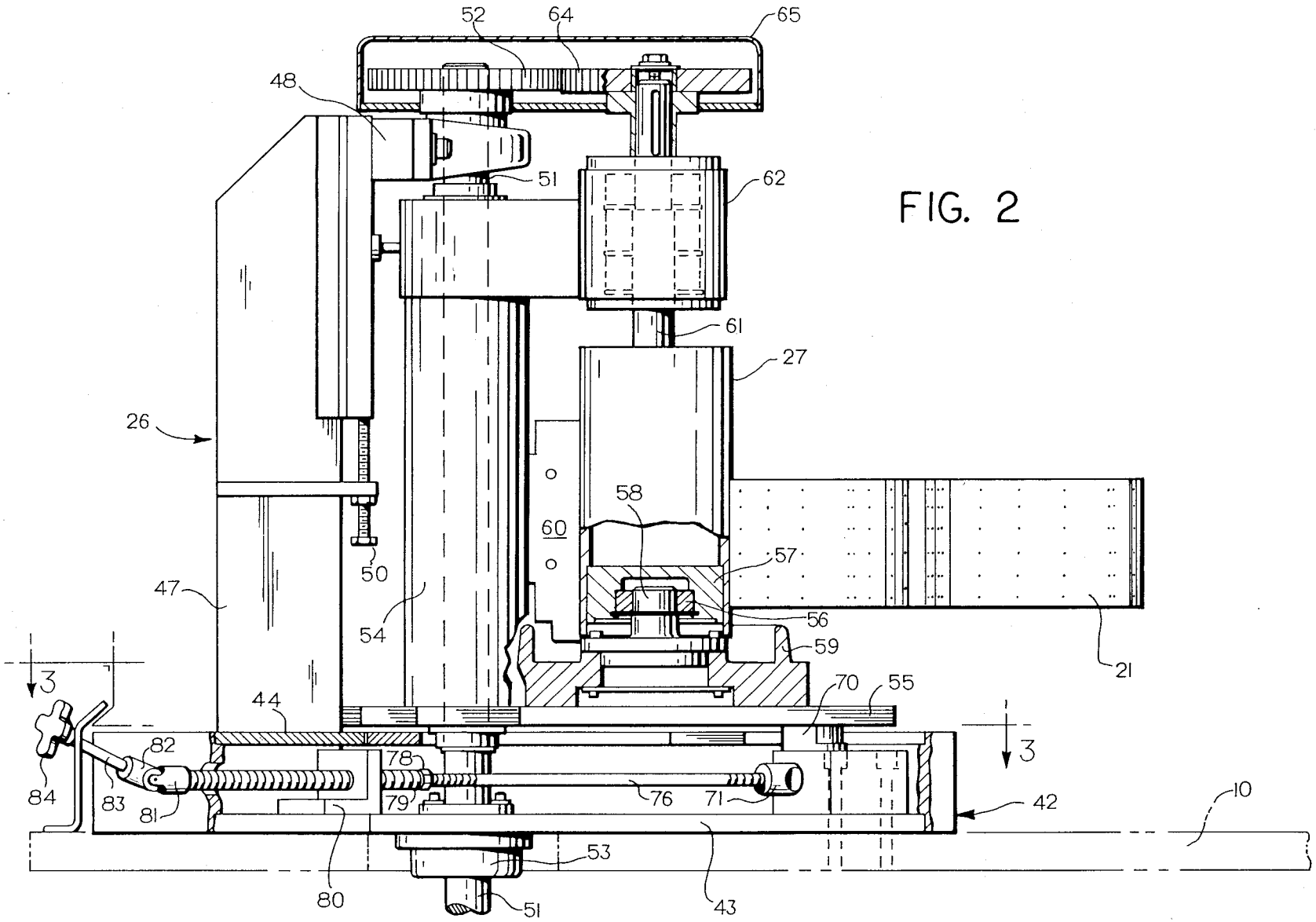
FIG. 2 is an enlarged side elevational view, with parts broken away, of the solvent applying station of FIG. 1.
Figure 3:
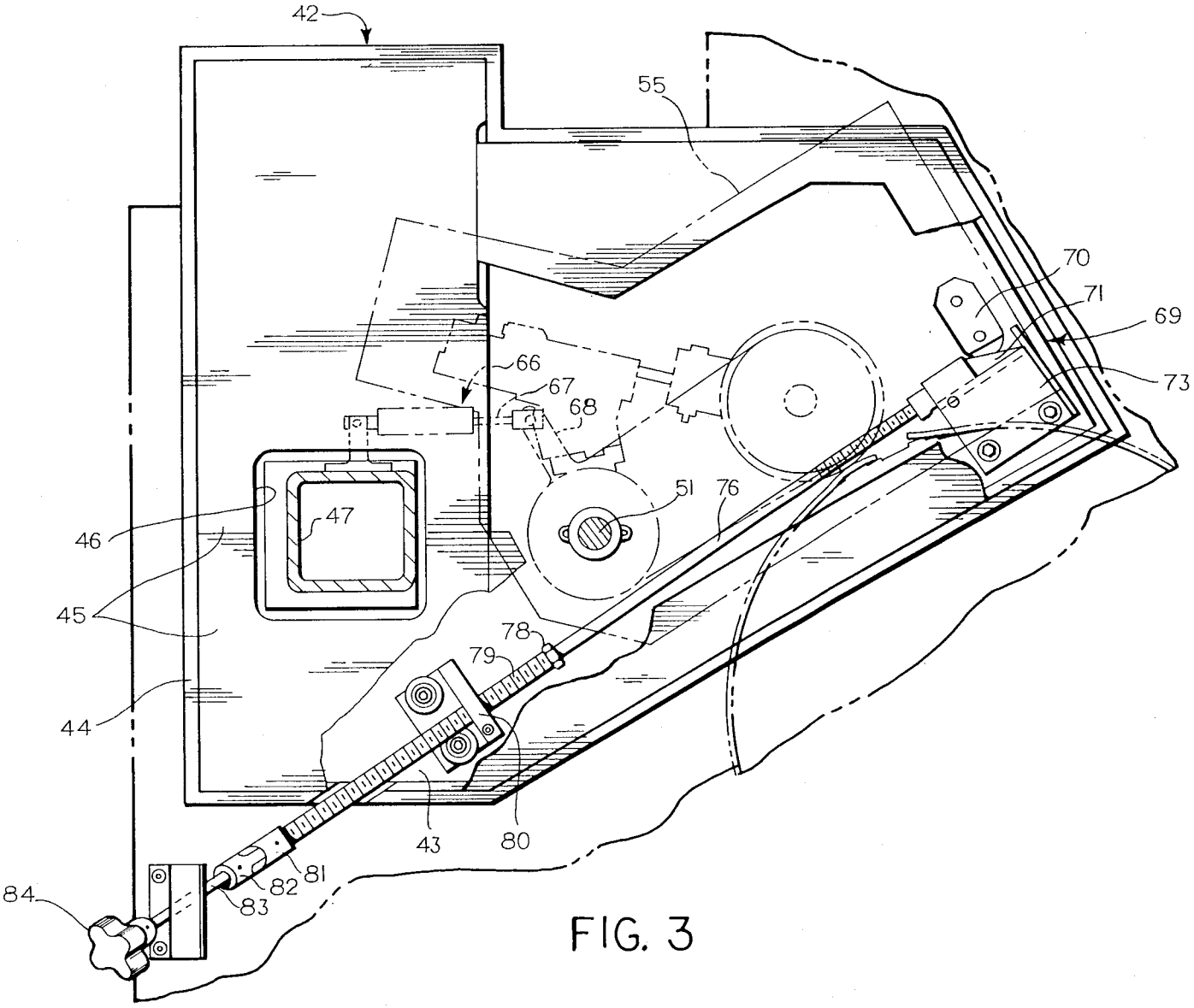
FIG. 3 is a cross-sectional view taken at line 3—3 of FIG. 2.
Figure 4:
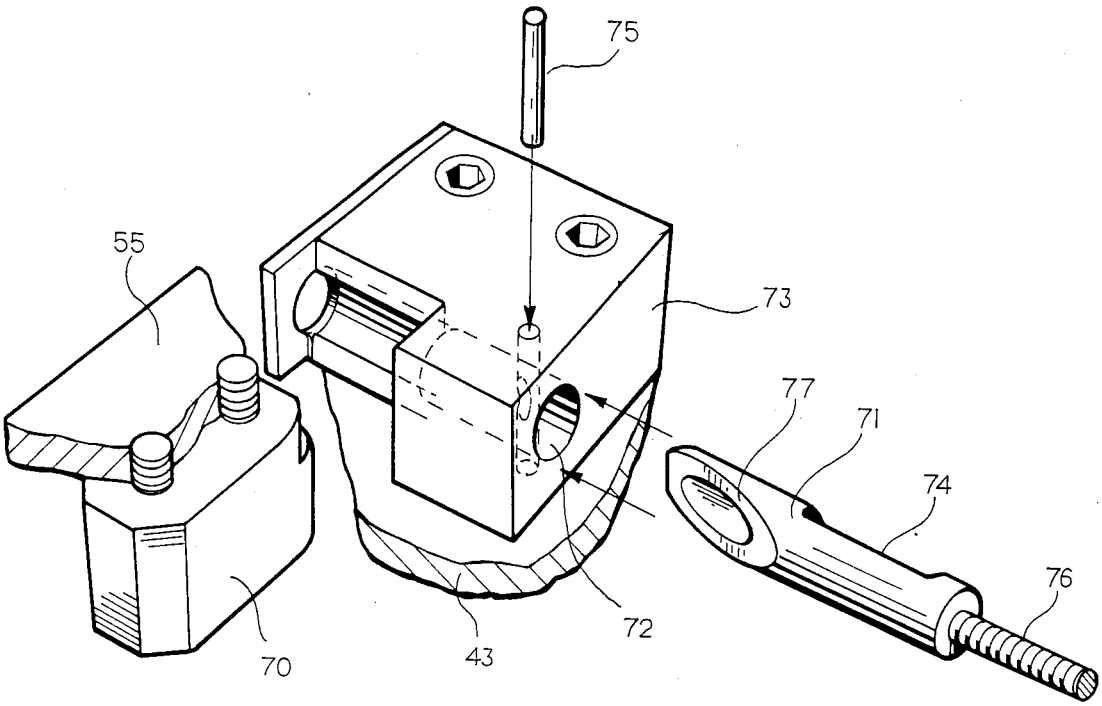
FIG. 4 is an exploded perspective view, on an enlarged scale, of a portion of the adjustment mechanism of FIG. 3.

Turning to FIGS. 2–4, the particular gravure roll mounting and adjusting means will be described in detail. The solvent applying station 26 is supported by 47 above a generally hollow, shallow base structure 42 resting on the top of the table 10. The base structure 42 comprises a horizontal bottom plate 43 with a peripheral, vertical wall 44 extending up from the plate 43. The wall 44 serves as an enclosure for the adjusting mechanism of the invention and has several cover plates 45 closing off areas of the top thereof. The cover plates leave an opening 46 through which a main support pedestal 47 extends with the pedestal being fixed to the table 10. Extending outwardly, as seen in FIGS. 1 and 2, from the pedestal 47 is a support bracket 48 that is mounted on a vertical slide 49 which is vertically adjustable relative to the pedestal by an adjusting bolt 50. The bracket 48 supports the upper end of a vertical shaft 51. The shaft 51 has a spur gear 52 mounted to its upper end. The lower end of the shaft 51 extends through a lower bearing housing 53 which is mounted on the bottom plate 43. The shaft extends down through an opening in the table and is driven by a drive means (not shown).

Surrounding the shaft 51 is a vertical sleeve 54 with suitable intermediate bearings to permit the sleeve to rotate about the axis of the shaft 51. The lower end of the sleeve is fixed to a horizontal platform 55. The platform 55 is likewise movable in its horizontal plane about the axis of the shaft 51. The platform 55 supports a bottom bearing 56 for the gravure roll 27. The bearing 56 is held between an inner bottom closing member 57 and a vertical stub shaft 58. The stub shaft is mounted on the center of an annular, fluid collecting chamber 59 which is positioned on the platform in generally surrounding relationship to the bottom of the gravure roll. The outer surface of the gravure roll is supplied with a solvent from a vertical fountain 60 and any excess solvent is free to flow down the roll surface into the chamber 59 from which it may be recycled to the fountain.

The gravure roll 27 is rotated by a drive shaft 61 which extends vertically above the roll through a bearing housing 62 which surrounds the shaft. The bearing housing 62 is supported, in the position shown in FIG. 2, by an arm 63 which extends from the housing 62 to the upper area of the sleeve 54. The upper end of the shaft 61 extends through the bearing housing and has a spur gear 64 fixed thereto. The gear 64 is in mesh with the gear 52 on the drive shaft 51. Thus the rotation of the drive shaft 51 will rotate the gravure roll 27. A cover 65 is shown overlying both spur gears.

As previously explained, the drum 21 carrying the labels is rotated so the labels will contact the gravure roll 27 and receive the solvent (in the case of a solvent seal system) or an adhesive (in the case of a glue or hot melt system). The gravure roll 27 is biased in the direction of the drum 21 by horizontally positioned piston motor 66 whose casing is mounted to the side of the pedestal 47 (See Fig. 3) and its piston rod 67 is coupled to a radial arm 68 fastened to the sleeve 54.

As viewed in FIGS. 1 and 3, the gravure roll 27 is biased about the axis of the sleeve 54 toward the drum 21. In order to accurately control the spacing between the outer surface of the roll and the surface of the drum an adjustable stop 69 (See FIG. 4) is provided. The stop 69 comprises a stop block 70 which is bolted to the underside of the platform 55. A linearly shiftable, wedge-shaped member 71, adapted to engage the stop block 70, is guided wit-in an opening 72 of a guide block 73. The guide block 73 is bolted to the bottom plate 43. The wedge member 71 has a horizontal notch 74 cut along the back thereof which cooperates with a pin 75 that extends through the block 73 after the member 71 is mounted in the opening 72. The pin prevents the member 71 from rotating when a threaded shaft 76, which threads into the end thereof, is rotated. Rotation of the shaft 76 will cause the member 71 to move axially in the opening 72 and the bevel surface 77 thereof which is in contact with the block 70 to move toward or away from the block 73. The shaft 76 is also provided with threads at its other end which carries a lock nut 78 threaded thereto. The shaft 76 also threads into the end of a larger, threaded rod 79. With the stop nut 78 out of contact with the end of the threaded rod 79, the relative length of the rods 79 and 76 may be adjusted. The rod 79 threads through a bracket 80 which is bolted to the bottom plate 43. One element 81 of a universal coupling is fixed to the end of the rod 79 while the other element 82 of the coupling is connected to a rod 83. The rod 83 extends out from the base structure 42 and terminates in a hand knob 84.

The knob 84, when rotated, will cause the threaded rod 79 to move longitudinally under the influence of the threads in the stationary bracket 80. Horizontal shifting of the rod 79 will move the shaft 76 also. However, rotation of the shaft 76, since it is threaded in the non-rotary member 71, will effectively let the shaft 76 pass through the member 71 without moving the member as much as the movement of the rod 79. In effect, the linear movement of the member 71, which would have been caused by the threading of the rod in the bracket 80, will be partially offset by the reduction in length of the shaft 76 due to its threading into the member 71 caused by the initial rotation of the rod 79.

Thus it can be seen that an extremely fine or microadjustment is provided for the gap between the gravure roll 27 and the drum 21. The view of FIG. 3 shows the relationship of the adjustment which is applied by relative movement between the blocks 70 and 73, with the axis of movement being about the shaft 51.

In the prior art systems the adjustment was in the manner of a threaded bolt engaging the side of the platform 55 fairly near the axis of the mounting shaft 51.

The mechanical advantage of the prior art was operating through a short lever arm while in the present case the lever arm is from the shaft 51 to the surface or face 77 of the member 71 with this position being beyond the point of tangency between the roll 27 and drum 21. Thus it can be seen that it was nearly impossible to make fine adjustments with the prior system because a fraction of a rotation of the screw would be magnified in the roll movement. With the system of the invention the rotation of the knob 84 can be several turns before there is any sensible movement of the roll relative to the drum. This degree of sensitivity is very desirable, if the setting of the relative positions of the roll and drum can be changed during operation to fine tune the process and to compensate for minor degrees of wear in the drum surface.

While the foregoing constitutes the Applicant's best mode contemplated for carrying out the invention, obvious modifications will be apparent to one versed in the art, which modifications will not depart from the spirit and scope of the invention as claimed.

What is claimed:

1. In a container labeling system in which labels are carried on the surface of a cylindrical vacuum transfer drum that is rotated about its vertical axis with the labels being engaged at the trailing and leading edges thereof by a rotating gravure roll for transferring a solvent to the labels at said edges, the improvement in the adjustment of the gravure roll vertical axis relative to the axis of the vacuum transfer drum comprising, a horizontal platform, means mounting said platform for horizontal pivotal movement about a fixed vertical axis, means on said platform for supporting the gravure roll for rotation about a vertical axis, a block secured to a surface of the platform said block being mounted to said platform at a point on one side of a vertical plane including the axes of the vacuum drum and gravure roll with the fixed axis about which the platform is rotatable being on the opposite side of said plane, an elongated, internally threaded member having a vertical, beveled surface in engagement with a vertical surface of said block, an externally threaded shaft having one end threaded into said threaded member, a stationary guide limiting said threaded member to linear movement, an elongated, internally and externally threaded rod connected to the other end of said shaft, a stationary bracket having a threaded opening therethrough, said rod threaded through said opening in said bracket, said external threads on said shaft and rod having the same direction, and means biasing the gravure roll toward the drum and biasing said block into engagement with said threaded member whereby the gravure roll is held against the label bearing drum with and adjustable force.

2. The apparatus of claim 1 further comprising means for adjusting the connection between said shaft and rod for adjusting the combined length of said rod and shaft.

3. The apparatus of claim 1 wherein said means for rotating said rod comprises a hand knob mounted to the end thereof and wherein said block and beveled member are at a location which is otherwise inaccessible.

* * * * *